US005915633A

United States Patent [19]

Biller

[11] Patent Number: 5,915,633

[45] Date of Patent: Jun. 29, 1999

[54] BUCKLE FOR SAFETY BELTS

[75] Inventor: Joachim Biller, Lorch, Germany

[73] Assignee: TRW Occupant Restraint Systems GmbH, Alfdorf, Germany

[21] Appl. No.: 08/870,849

[22] Filed: Jun. 6, 1997

Related U.S. Application Data

[63] Continuation of application No. 08/605,095, filed as application No. PCT/EP95/02945, Jul. 25, 1995, abandoned.

[30] Foreign Application Priority Data

Jul. 29, 1994 [DE] Germany ..... 44 27 011

[51] Int. Cl.[6] ..... A44B 11/00

[52] U.S. Cl. ..... 24/641; 24/637; 24/642

[58] Field of Search ..... 24/641, 642, 640, 24/639, 643, 645, 633, 637, 646

[56] References Cited

U.S. PATENT DOCUMENTS

| | | | |
|---|---|---|---|
| 4,100,657 | 7/1978 | Minolla | 24/642 |
| 4,468,843 | 9/1984 | Duclos et al. | 24/642 |
| 4,543,693 | 10/1985 | Cunningham | 24/641 |
| 4,899,424 | 2/1990 | Barnes et al. | 24/637 |
| 5,066,042 | 11/1991 | Fohl | 24/641 |
| 5,097,571 | 3/1992 | Fohl | 24/641 |
| 5,341,546 | 8/1994 | Burke | 24/641 |
| 5,542,162 | 8/1996 | Biller | 24/641 |

FOREIGN PATENT DOCUMENTS

| | | |
|---|---|---|
| 0212507 | 4/1987 | European Pat. Off. . |
| 3837376 | 5/1990 | Germany . |
| 3932067 | 4/1991 | Germany . |
| 4009272 | 9/1991 | Germany . |

*Primary Examiner*—Victor N. Sakran
*Attorney, Agent, or Firm*—Tarolli, Sundheim, Covell, Tummino & Szabo

[57] ABSTRACT

A safety belt buckle based on the well accepted pivotal latch design has simple measures for adaptation for use with a belt pretensioner. The pivotal latch (16) is secured in a fastened position by a locking plate (20). The locking plate (20) is for its part held in position by two locking balls (36), which are retained between a recess (28) in the locking plate and an arrest plate (30) adapted to shift in parallelism to the locking plate. For unfastening the buckle it is firstly necessary for such arrest plate (30) to be actuated by way of an inertial mass-compensated system.

The buckle is furthermore made proof against extremely high levels of acceleration in all directions.

7 Claims, 8 Drawing Sheets

BUCKLE FOR SAFETY BELTS

This application is a continuation of application Ser. No. 08/605,095 filed on Mar. 8, 1996, abandoned, International Application PCT/EP95/02945 filed on Jul. 25, 1995 and which designated the U.S.

The invention relates to a buckle for safety belts comprising a pivotal latch, a load bearing frame in which said latch is pivoted, said latch being adapted in a locking position to engage a catch edge of an insertable catch member, a locking member mounted on the frame for sliding movement athwart the direction of pivoting of the pivotal latch between an open position, in which it releases the pivotal latch and a locking position, in which it arrests the pivotal latch in an engagement position thereof, and furthermore a release button also mounted on the frame, whose actuation is arranged to cause movement of the locking member into the open position.

Such a pivotal latch buckle is for example disclosed in the German patent publication 4,009,272 A1. The locking member designed in the form of a plate is in this design held in engagement with the pivotal latch by a compression spring and is directly shifted by the release button. The forces occurring at the release button and at the locking plate owing to inertia at the end of a belt pretensioning movement, by which the buckle is displaced toward the floor of the vehicle, are directed in the opening direction of the disengagement button so that special measures must be taken to prevent accidental release of the buckle. For this purpose a locking pawl is supported on the disengagement button, which owing to its inertia is pivoted if the release button is suddenly accelerated and fits into a detent opening in the frame of the buckle. The pivoting of the pawl must take place very smartly to ensure that the intended locking of the release button does in fact occur. In the case of extremely high acceleration rates of the buckle this cannot always be guaranteed. Furthermore loads to be resisted by the pawl assume very high values involving both the overall mass of the release button and also that of the locking plate and the locking pawl itself.

The invention provides a buckle for safety belts, which is proof against accidental unfastening even in the case of extremely high acceleration values of 4000 g or more and does not involve any principal departures in design from generally accepted designs using the pivotal latch system.

In accordance with the invention the locking member, which maintains the pivotal latch in its locked position, is arrested by at least one locking body in the locking position, such body being able to be moved between an arrest position and a release position in a direction athwart the direction of shift of the locking member. Owing to its mobility being limited to the direction athwart the direction of shift of the locking member the locking member does not respond to acceleration in a direction aligned with the direction of actuation of the release button. Accordingly the locking body will remain in its arrest position even in the case of extremely high acceleration values in such direction. The buckle is therefore reliably locked independently of the timing of events.

In the case of a first advantageous working embodiment of the buckle the locking body can for its part be held in its arrest position by an arrest plate adapted to move in parallelism to the direction of displacement of the locking member. Accordingly on the one hand the locking member is held by the locking body against acceleration in the direction of actuation of the release button, and on the other hand the locking body is for its part held against acceleration athwart this direction by the arrest plate. The result of this is that the buckle is generally secured against acceleration in every direction.

For unfastening the buckle, in the case of this embodiment, it is firstly necessary to shift the arrest plate in order to free the locking body, which then for its part enables displacement of the locking member in order to free the pivotal latch. The necessary movement may be readily produced by means of a bell crank which is pivoted on the locking member and whose first end is engaged by the release button and whose second end is connected with the arrest plate. The bell crank, the arrest plate and the parts acting on the same of the release button are inertially balanced with respect to acceleration in the direction of actuation of the release button so that even in the case of extremely high values of such acceleration they will remain, relatively speaking, at rest.

The second advantageous embodiment of the buckle is based on the same principle as the first one. The locking body is however held in its arrest position by means of a two armed arrest lever bearinged for turning about the rolling element. The release button preferably engages the first arm of the arrest lever; the second arm of the arrest lever constitutes an inertial balancing mass, by which the mass of the release button is compensated for. Even in the resting state of the buckle the locking member is arrested by the locking body in the locking position, and this state will be maintained even in the case of an extreme acceleration in any direction, since all masses taking part in the arresting operation compensate each other.

However in accordance with an advantageous development of the invention over-compensation is provided, by which the arrest lever is held securely against an abutment on the frame of the buckle even in the case of unusual directions of acceleration. This over-compensation is caused by an additional inertial mass, which is pivotally mounted alongside the arrest lever on the locking body and is coupled with the first arm of the arrest lever on its side remote from the release button by being held by a spring in a yielding fashion abutting this first arm.

Further advantageous developments and convenient forms of the invention will be understood from the following detailed descriptive disclosure of two embodiments thereof in conjunction with the accompanying drawings.

Figure 1:
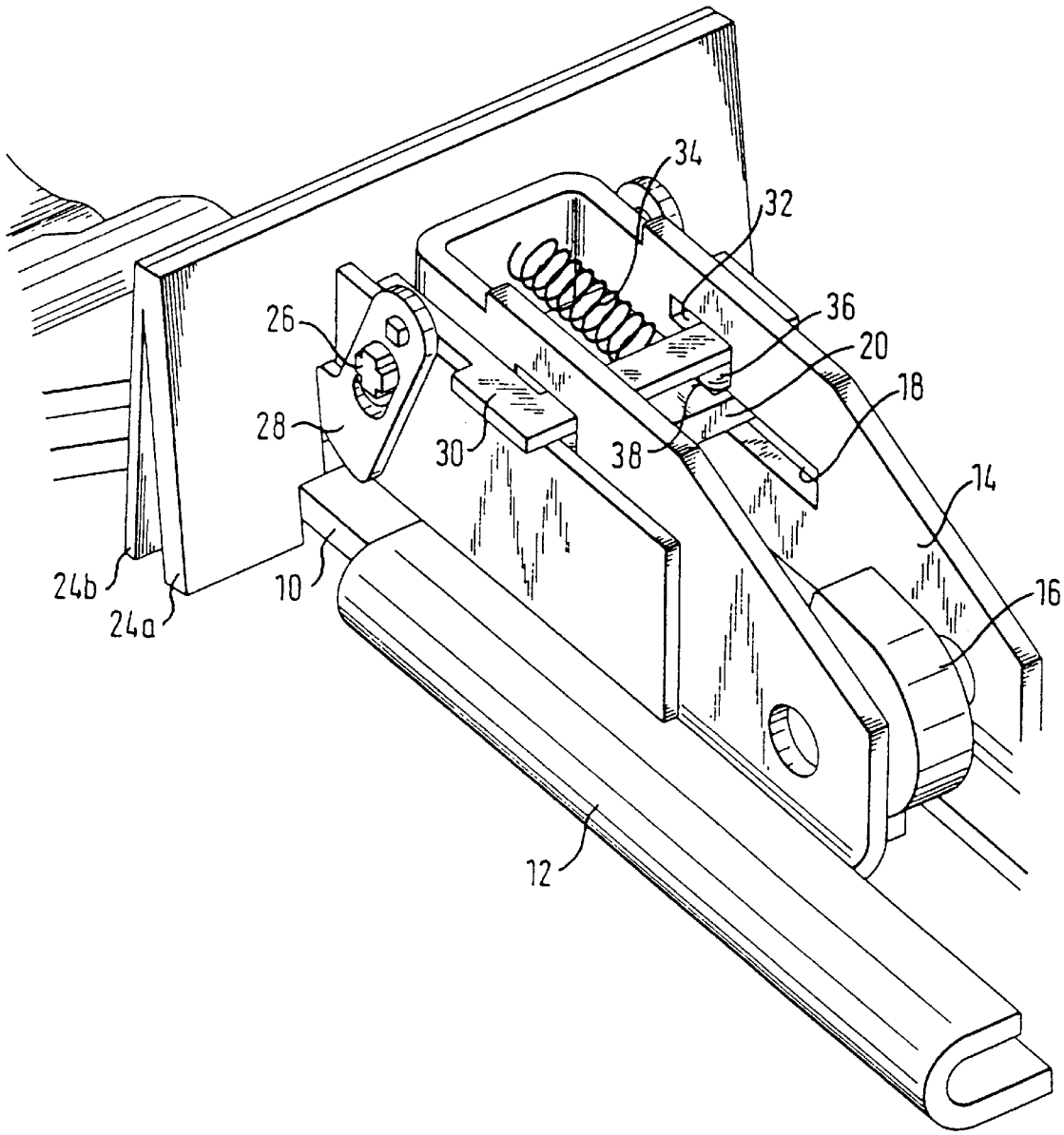
FIG. 1 shows a diagrammatic perspective elevation of the main functional parts of the first embodiment of the buckle.

The buckle for safety belts constituting the embodiment illustrated in FIGS. 1 through 5 connects a conventional insertable catch member 10 with a fitting 12, which may be acted upon by a belt pretensioner, a so-called buckle pretensioner. The buckle comprises a load bearing frame 14, connected with the fitting 12 and which as seen in plan view has a U-shaped bent configuration, between whose limbs a pivotal latch 16 is mounted for pivoting movement. In the fastened state (FIG. 2) a hook 16*a* on the pivotal latch 16 engages a catch edge 10*a* on the insertable catch member 10. In two guide slots 18, which are parallel to one another and to the insertable catch member 10, in the limbs of the frame 14 a locking plate 20 is mounted for sliding motion. A compression spring 22 is arranged between the locking plate 20 and a support surface 16*b* on the pivotal latch 16 and urges the pivotal latch 16 in the opening direction, while simultaneously however urging the locking plate 20 into a locking position, in which it constitutes an abutment for an upwardly bent head 16*c* on the side, remote from the hook 16*a*, of the pivotal latch 16. Accordingly the locking plate 20 holds the pivotal latch 16 in its fastened position illustrated in FIG. 2.

The frame 14 furthermore bears a two-part release button 24*a* and 24*b* pivotally on it. The two parts 24*a* and 24*b* of the release button are adapted to pivot about a common axis and their free ends are urged apart by spring force. In this respect the part 24*a* of the release button abuts the adjacent edge of the locking plate 20.

On either side thereof the locking plate 20 possesses a respective projecting trunnion 26, on which a respective bell crank or lever 28 is pivotally mounted, such levers having slots 28*a* for this purpose. On the upper arm of the bell crank 28 an arrest plate 30 is connected in an articulated manner. The arrest plate 30 runs in two parallel guide slots 32 in the two limbs of the frame 14 in parallelism to the locking plate 20. By means of a compression spring 34 the arrest plate 30 is urged in a direction opposite to the direction in which the locking plate 20 is urged by the compression spring 18.

Figure 2:
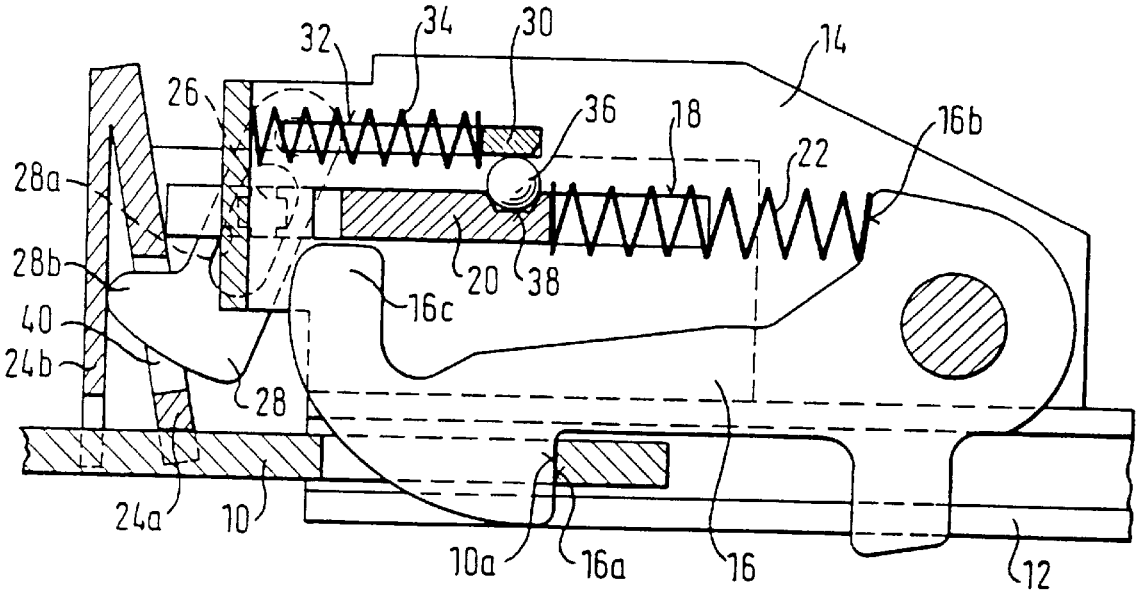
FIG. 2 is a diagrammatic side view of such buckle in its condition with the catch member inserted, the release button not being actuated.

In the fastened position depicted in FIG. 2 the end remote from the bell crank 28, of the arrest plate 30 is over two locking balls 36, which run in a respective recess 38 in the locking plate 20. The locking plate 30 prevents the locking balls 36 from coming out of the recesses 38 so that the locking plate 20 is arrested in position.

On its arm remote from the arrest plate 30 the bell crank 28 possesses a head 28*b*, which extends through an opening 40 in the part 24*a* of the release button and rests against its part 24*b*. The distribution of mass and the levers, which are involved, on the part 24*b* of the release button, on the pivotal latch 28 and on the arrest plate 30 are so selected that such parts are compensated and balanced as regards acceleration events in the direction of actuation of the release button. Even in the case of an extremely high acceleration in this direction such parts consequently remain without movement in relation to the frame 14 of the buckle. Accordingly the locking balls 36 are prevented from coming out of the recesses 38 so that the locking plate 20 is arrested in its locking setting and secures the pivotal latch 16 in its fastened position. If there is acceleration athwart the actuation direction of the release button the locking balls 36 are unable to move out of the way either, since they are trapped between the locking plate 20 and the arrest plate 30. The buckle will consequently not be affected by any level of acceleration no matter what the direction thereof.

Figure 3:
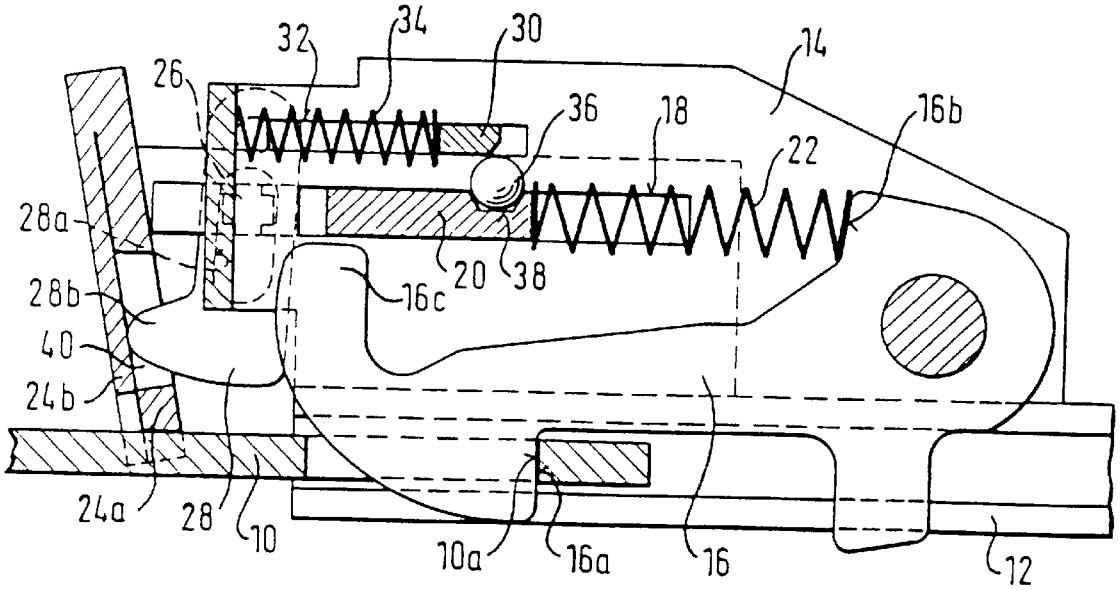
FIG. 3 shows the same buckle at the start of operation of the release button.

To unfasten the buckle, as is the case with a conventional pivotal latch buckle, the release button is moved in a direction, which corresponds to the direction of insertion of the insertable catch member 10. The part 24*b* of the release button firstly moves the head 28*b* of the bell crank 28 forward and pivots it with the result that the arrest plate 30 will be moved against the force of the compression spring 34 in the guide slots 32 until the locking balls 36 come free. In this state as depicted in FIG. 3, the parts 24*a* and 24*b* of the release button abut one another so that after the initial first actuating stroke the locking plate 20 is shifted in a second actuating stroke against the force of the compression spring 22.

Figure 4:
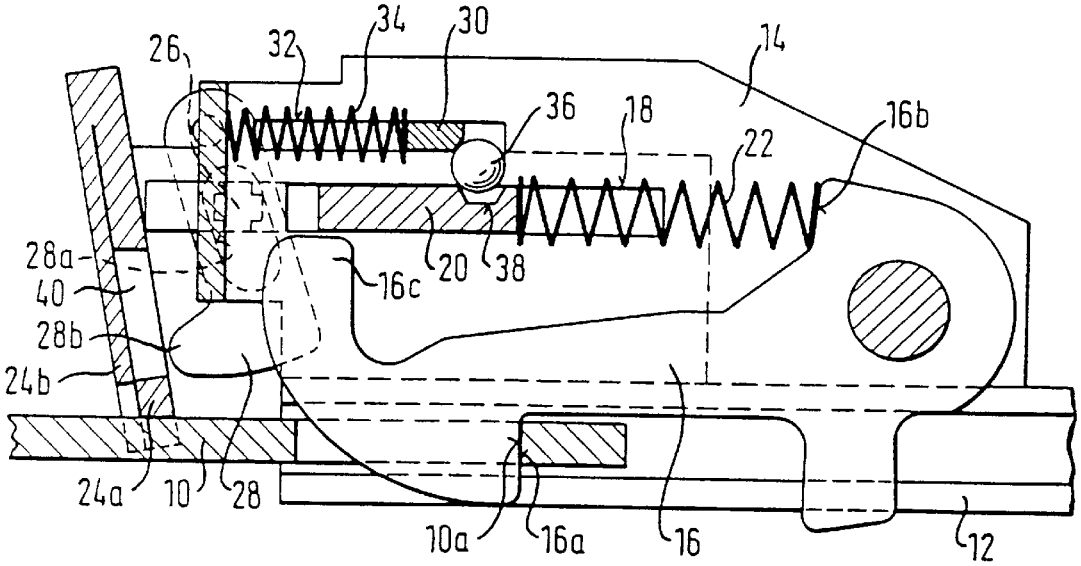
FIG. 4 shows the buckle in the terminal phase of operation of the release button.
Figure 5:
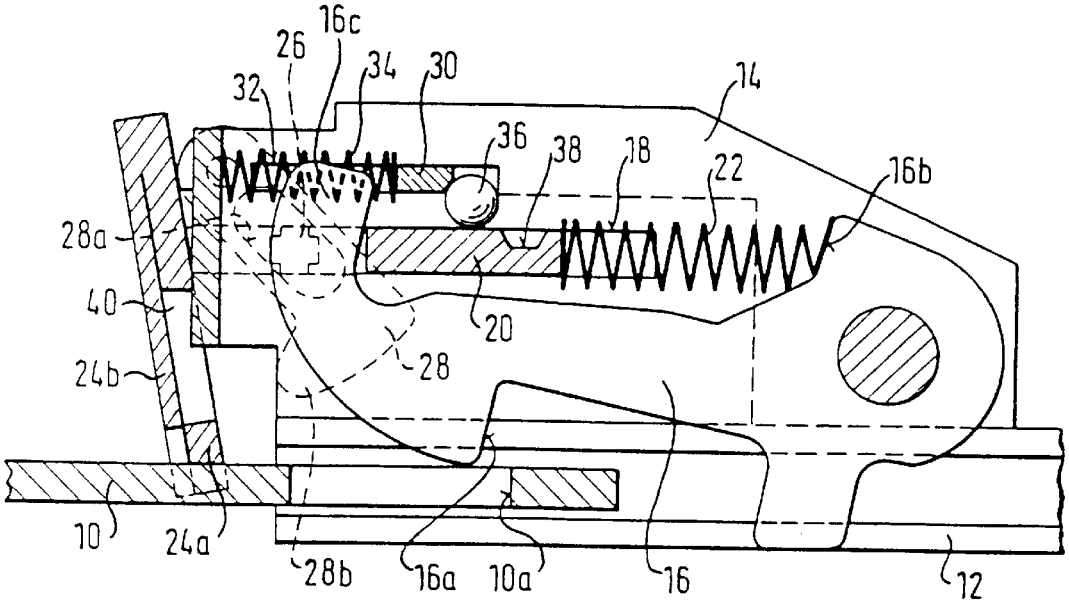
FIG. 5 shows the buckle in the unfastened state, the release button being fully depressed.

As shown in FIG. 4, the locking balls 36 are pressed out of the recesses 38 so that the locking plate 20 may be further displaced until it releases the pivotal latch 16. The latter is now pivoted in the clockwise direction by the compression spring 22, the hook 16*a* being cleared from the catch edge 10*a* of the insertable catch member 10 so that it may now be withdrawn from the buckle.

In FIGS. 6 through 10 those elements, which are essentially the same as in the embodiment in accordance with FIGS. 1 through 5, are denoted by reference numerals increased by 100. Again it will be seen that there is the load bearing frame 114 between whose limbs a pivotal latch 116 is mounted for swinging motion. In the fastened state (FIG. 7) the pivotal latch 116 has a hook 116*a* thereof in engagement with a catch edge 110*a* on the insertable catch member 110. In the fastened state the pivotal latch 116 is held by a locking plate 120, which on its lower surface possesses a recess extending over its full width. An elongated locking roller 136 fits into this recess and extends transversely through the limbs of the frame 114 and projects on either side; this locking roller 136 is mounted for shifting motion in two mutually opposite slots 137 in the limbs of the frame 114. These slots 137 extend perpendicularly to the direction of displacement of the locking plate 120.

At either end of the locking roller 136 a two armed arrest lever 130 is pivoted by means of bearing bushings 139. The two armed arrest lever 130 has a first arm 130*a*, which can be operated by an actuating spur on the release button 124*b*. The second arm 130*b* of the arrest lever 30 constitutes a compensating or balancing inertial mass, by means of which the sum of the masses of the release button 124*b* and of the first arm 130*a* is compensated for. In the case of the resting condition depicted in FIG. 6 the second arm 130*b* of the arrest lever 30 has its abutment surface 129*a* in engagement with an abutment 129 on the frame 114.

At each end of the locking roller 136 there is furthermore, adjacent to the arrest lever 139, an additional inertial mass 140 mounted in a rotatable fashion. Each of such inertial masses consists of two parallel jaws 140*a* and 140*b*, which are arranged on either side of the first arm 130*a* of the respective arrest lever 130 and are held by a limb spring 135 in engagement with the same on its side remote from the release button 124*b*.

The manner of operation of this buckle is similar to that of the embodiment described hereinbefore and will appear from FIGS. 7 through 10.

Figure 10:
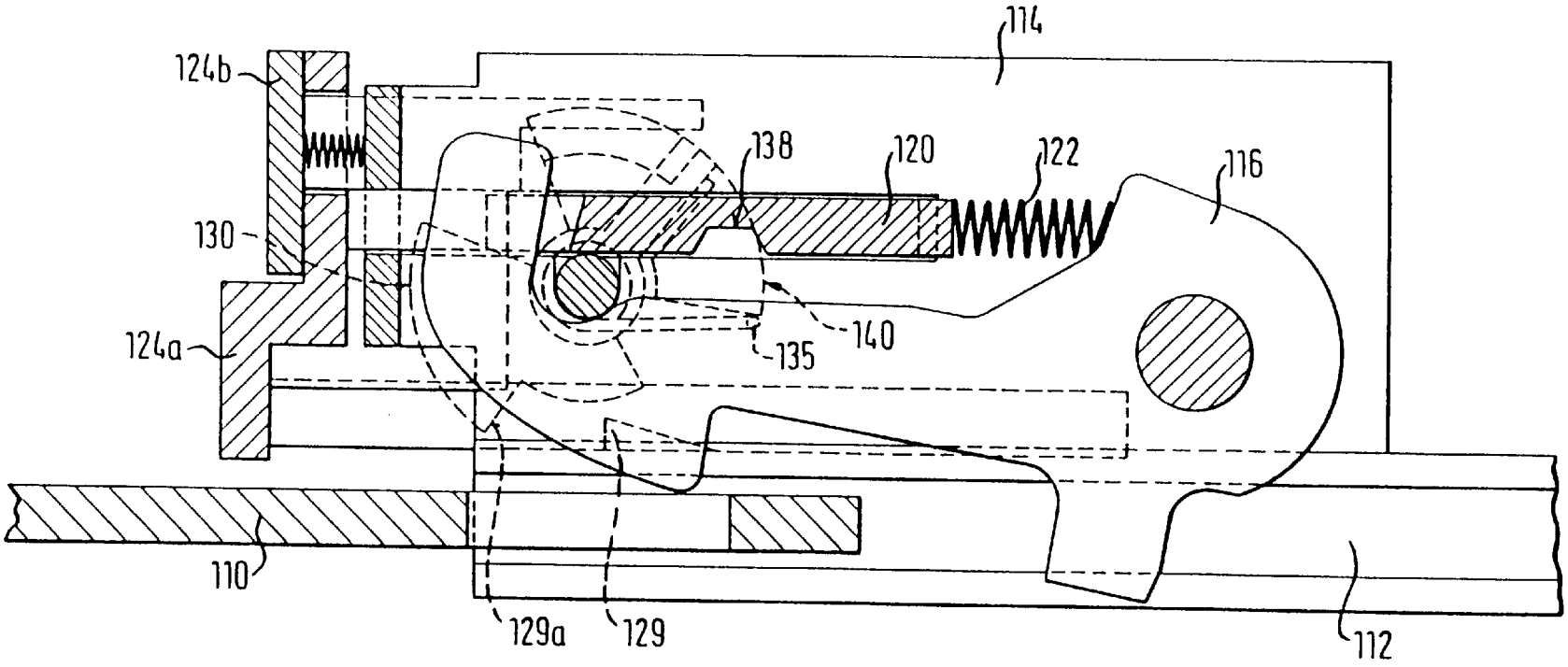
FIG. 10 shows the buckle in the unfastened state, the release button having been fully depressed.

On actuation of the release button 124*b* (FIGS. 7 and 8) the arrest lever 130 is pivoted, the abutment surface 129*a* coming clear of the abutment 129. As soon as the abutment surface 129*a* has been turned past a vertical line drawn through the axis of the locking roller 136 toward the insertable catch member 110, a moment will be acting on the locking roller 136 tending to shift it out of the recess 138 toward the insertable catch member 110. On further rotation out of the position indicated in FIG. 8 toward the setting depicted in FIG. 9, the locking roller 136 will be moved toward the lower end of the slots 137 so that it will now be completely clear of the recess 138 and the locking plate 120 will be released. On further actuation of the release button 124*b* the part 124*a* thereof will now be engaged with the result that the locking plate 120 is directly changed in position hence releasing the pivotal latch 116, which will now move into the open position as depicted in FIG. 10.

Figure 6:
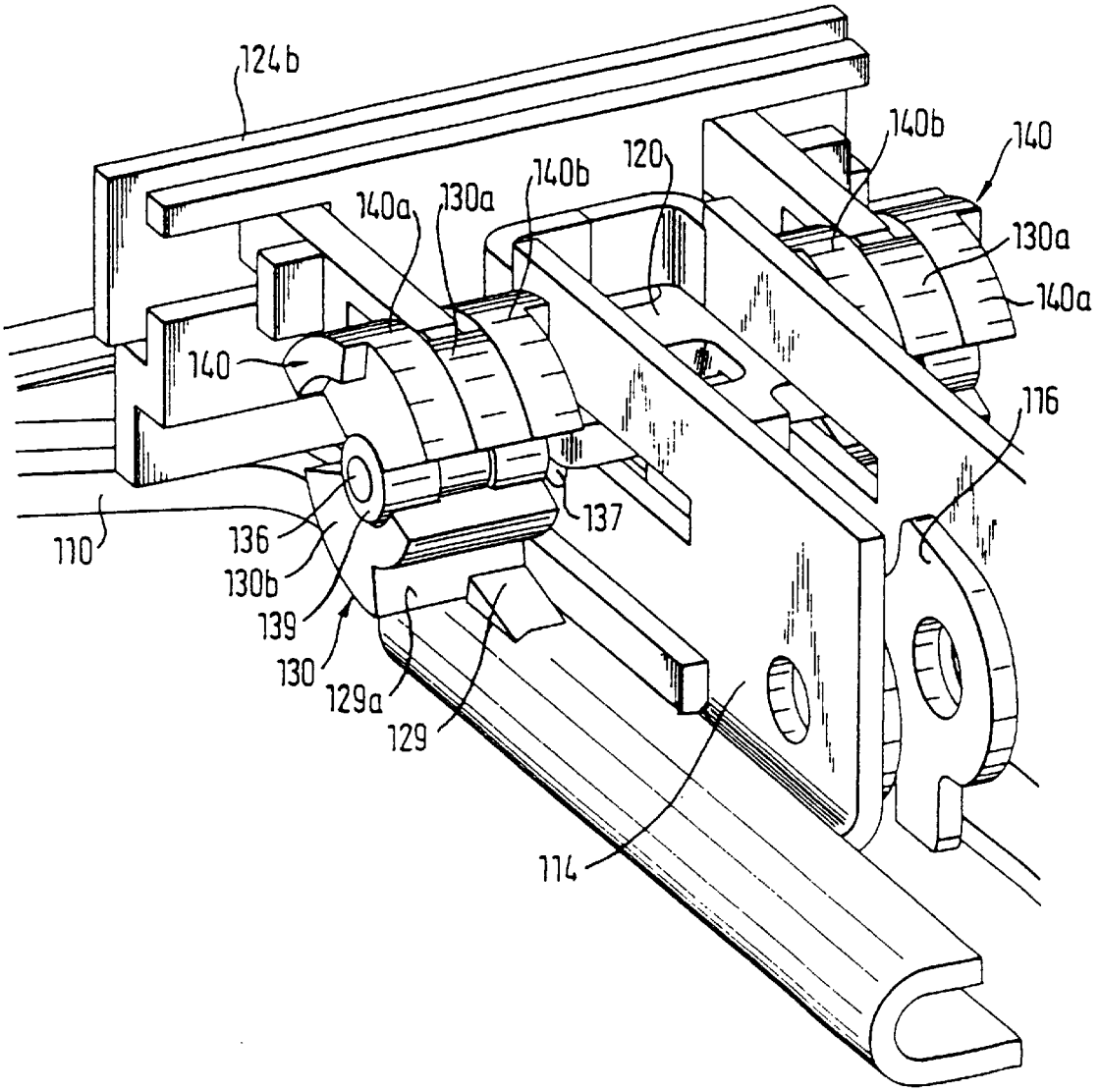
FIG. 6 is a diagrammatic perspective elevation of the main functional parts of the second embodiment of the buckle.
Figure 7:
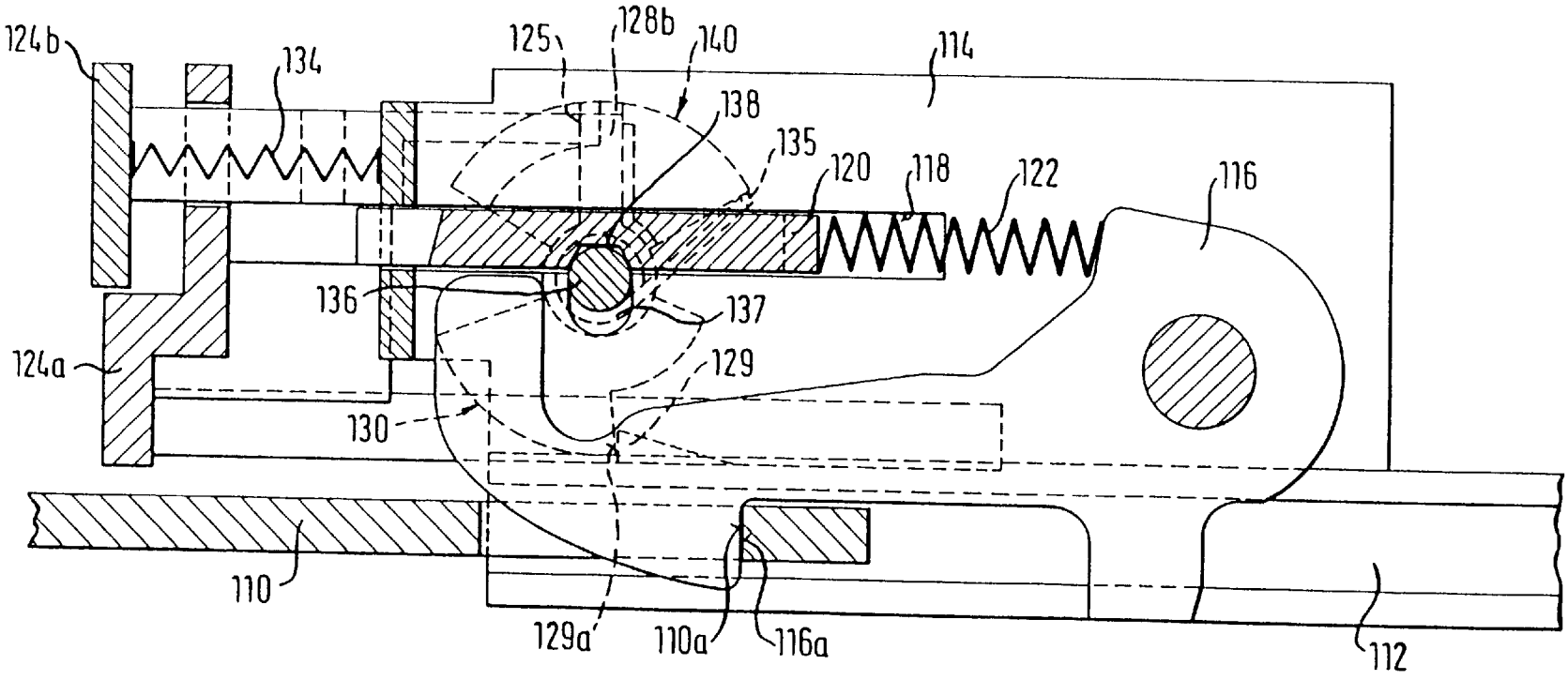
FIG. 7 is a diagrammatic side view of such buckle with the insertable catch member in place, the release not having been actuated.
Figure 8:
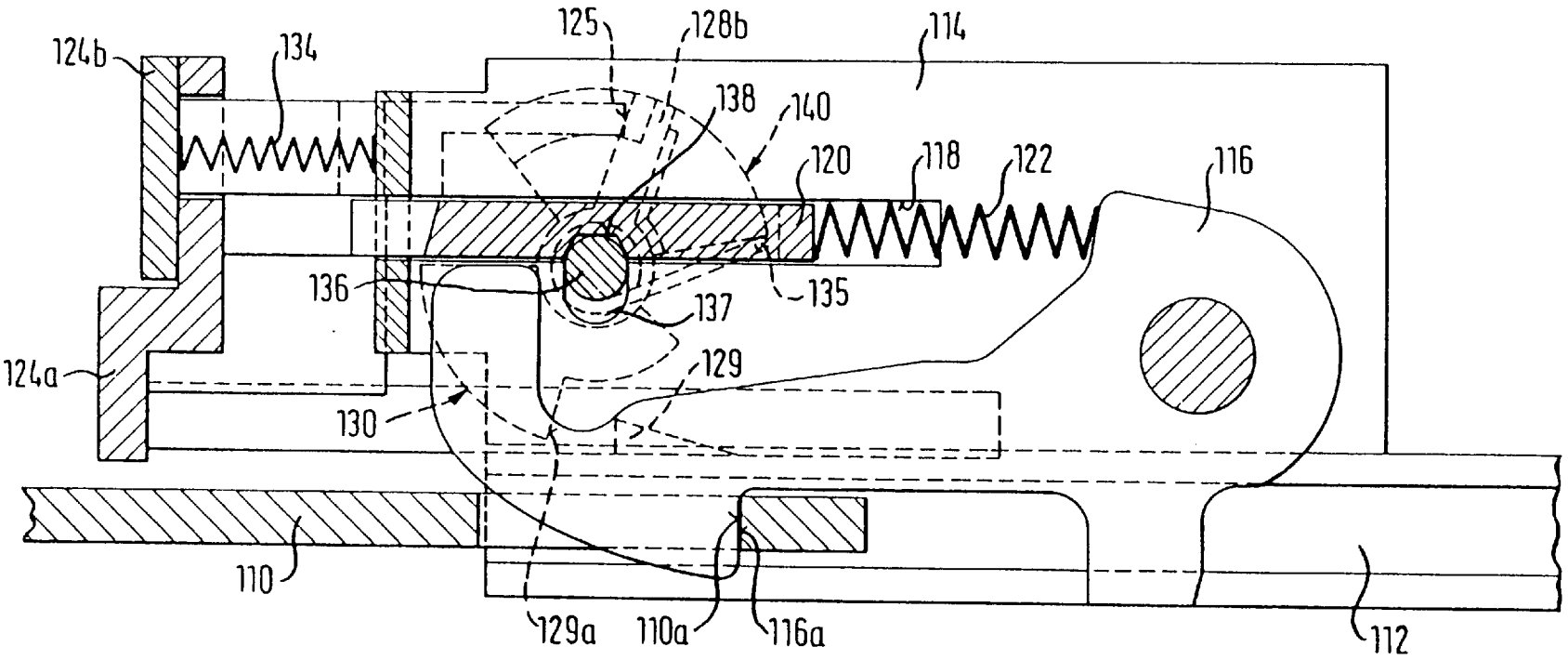
FIG. 8 shows the same buckle at the commencement of actuation of the release button.
Figure 9:
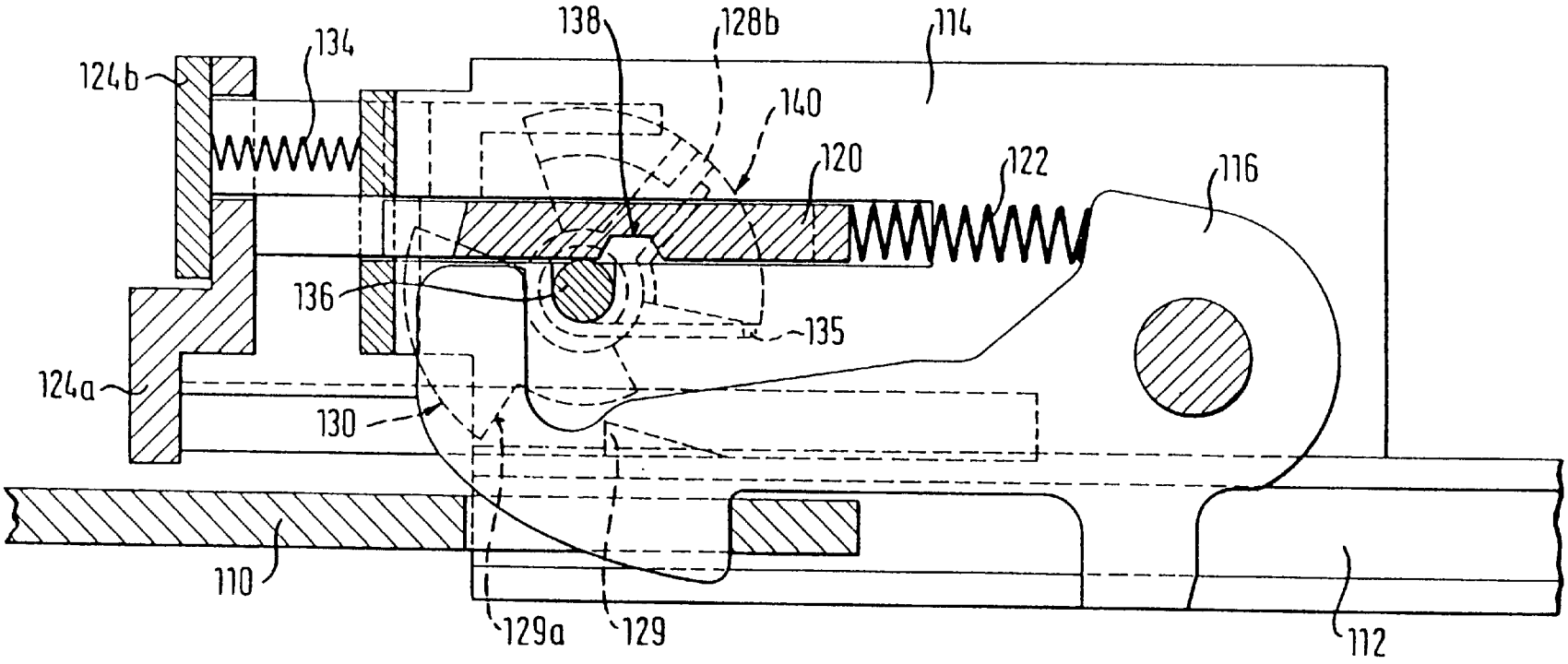
FIG. 9 shows the buckle in the terminal phase of actuation of the release button.

In the case of the resting state illustrated in FIGS. 6 and 7 with the insertable catch member 110 inserted and secured all masses taking part in the opening movement are compensated in every direction of acceleration. Overcompensation is produced by the additional inertial masses 140, which are thrust against the first arm 130*a* of the arrest lever 130 during acceleration of the buckle in the opening direction of the release button 124*b* and consequently amplify the thrust of the abutment surface 129*a* on the abutment 129. It is in this manner that safety as regards acceleration in an unexpected direction, such as in the case of a complex traffic crash, is increased. The additional inertial masses 140 are however uncoupled, on acceleration of the buckle in a direction opposite to the actuation direction of the release button 124*b*, from the arrest lever 130, since then the limb spring 138 will give way.

I claim:

1. A buckle for safety belts comprising a pivotal latch (116), a load bearing frame (114) in which said latch is pivoted, said latch being adapted in a locking position to engage a catch edge of an insertable catch member (110), a locking member (120) mounted on the frame (114) for sliding movement athwart the direction of pivoting of the pivotal latch (116) between an open position, in which it releases the pivotal latch, and a locking position, in which it arrests the pivotal latch in an engagement position thereof, and furthermore a release button (124*a*, 124*b*) also mounted on the frame, whose actuation is arranged to cause movement of the locking member (120) in to the open position, characterized in that the locking member (120) is for its part arranged to be arrested by at least one locking body (136) in the locking position, such body being able to be moved athwart the direction of displacement of the locking member (120) between an arrest position and a release position, the locking body (136) being constituted by a roller body, which fits into a recess (138) in the locking member (120), the locking body (136) being able to be held in an arrest position thereof by a two armed arrest lever (130) mounted for turning about the roller body.

2. The buckle as claimed in claim 1, characterized in that the first arm of the arrest lever (130) is engaged by the release button (124) and the second arm constitutes a compensating inertial mass, by which the mass of the release button is balanced.

3. The buckle as claimed in claim 1, characterized in that the roller body (136) runs in at least one slot, extending perpendicularly to the direction of displacement of the locking member (120), in the frame (114) and is able to be changed in position together with the arrest lever (130) between the ends of the slot.

4. The buckle as claimed in claim 1, characterized in that by dint of engagement on an abutment (129) of the frame the arrest lever (130) is kept in an arrest position at the end, adjacent to the locking member (120), of the slot and by pivoting may be moved away from the abutment (129) under the action of the release button on its first arm into a release position at the other end of the slot.

5. The buckle as claimed in claim 1, characterized in that an inertial mass (140), which is able to turn about the roller body (136), is held in engagement on the side, which is remote from the release button, of the first arm of the arrest lever (130) by a resilient force.

6. The buckle as claimed in claim 1 or any one of the preceding claims 2 through 5, characterized in that the locking body (136) is in the form of an elongated locking roller, which extends through the frame (114) with both its ends extending past same and in that on each end of the locking roller (136) an arrest lever (130) is arranged.

7. A buckle for safety belts comprising:

a load bearing frame;

a pivotal latch pivotable relative to said frame between a locking position, in which said pivotal latch is engageable with a catch edge of a catch member, and a release position;

a locking member slidably mounted on said frame, said locking member having a locking position, in which said locking member prevents said pivotal latch from moving from the locking position, and an open position, in which said pivotal latch is pivotable relative to said frame, said locking member being movable in a direction transverse to a direction of pivoting of said pivotal latch;

a release button mounted on said frame for causing movement of said locking member from the locking position to the open position;

a roller body for preventing said locking member from moving from the locking position to the open position, said roller body being movable between an arrest position, in which said roller body prevents movement of said locking member from the locking position to the open position, and a release position in a direction transverse to the direction of movement of said locking member from the locking position to the open position; and a two armed arrest lever rotatably mounted on said roller body, said roller body being held in the arrest position by said arrest lever.

* * * * *